US009246240B2

(12) United States Patent
Bartell

(10) Patent No.: US 9,246,240 B2
(45) Date of Patent: Jan. 26, 2016

(54) ELECTRICAL CONNECTOR ASSEMBLY WITH DETACHABLE PIVOT SHAFT AND PIVOT HUB WITH INSERT

(71) Applicant: Jack R Bartell, Marana, AZ (US)

(72) Inventor: Jack R Bartell, Marana, AZ (US)

( * ) Notice: Subject to any disclaimer, the term of this patent is extended or adjusted under 35 U.S.C. 154(b) by 63 days.

(21) Appl. No.: 14/282,414

(22) Filed: May 20, 2014

(65) Prior Publication Data

US 2015/0340775 A1 Nov. 26, 2015

(51) Int. Cl.
*H01R 4/24* (2006.01)
*H01R 4/64* (2006.01)
*H01R 13/52* (2006.01)

(52) U.S. Cl.
CPC ..... *H01R 4/2404* (2013.01); *H01R 4/646* (2013.01); *H01R 13/5208* (2013.01)

(58) Field of Classification Search
CPC .. H01R 4/2433; H01R 4/2412; H01R 4/2404; H01R 13/506; H01R 9/0757
USPC ..... 439/404, 409, 410, 425
See application file for complete search history.

(56) References Cited

U.S. PATENT DOCUMENTS

| | | | | |
|---|---|---|---|---|
| 4,426,125 A * | 1/1984 | Crawford | H01R 12/675 | 439/404 |
| 5,195,907 A * | 3/1993 | Urban | H01B 7/0823 | 439/406 |
| 5,435,747 A * | 7/1995 | Franckx | H01R 4/2433 | 439/409 |
| 5,667,402 A * | 9/1997 | Denovich | H01R 4/2433 | 439/409 |
| 8,951,061 B1 * | 2/2015 | Bartell | H01R 4/2412 | 439/409 |

* cited by examiner

*Primary Examiner* — Hien Vu
(74) *Attorney, Agent, or Firm* — Usha Koshy

(57) ABSTRACT

An electrical cable connector assembly comprising a top pivot shaft and a base pivot hub having an insert with fixture conductor channels form fitted on the base pivot hub to hold the fixture conductor wires. The top pivot shaft interlocks with the base pivot hub at one end and upon rotation at ninety degrees the connector assembly is closed completely. Upon closure with nominal hand force, a pair of metal conductor pins molded to the top inside end of the top pivot shaft easily penetrates the fixture conductor wires held in the insert and the source conductor wire held in the source conductor wire channel in the base pivot hub, to connect the two sets of conductors electrically. The small diameter of circumference at the mid section of the uniquely designed cable connector allows for the use of an optional closure to secure the cable connector in place.

5 Claims, 13 Drawing Sheets

ELECTRICAL CONNECTOR ASSEMBLY WITH DETACHABLE PIVOT SHAFT AND PIVOT HUB WITH INSERT

CROSS REFERENCE TO RELATED APPLICATION

This is a continuation-in-part application of U.S. patent application Ser. No. 14/021,398 filed on Sep. 9, 2013.

FIELD OF THE INVENTION

This invention is generally related to low voltage connectors. More particularly, the present invention is related to a connector assembly with a detachable pivot shaft and pivot hub to electrically connect fixture conductors with a source conductor using metal conductor pins.

BACKGROUND OF THE INVENTION

Electrical cable connectors in general are well known in the art. In the past, electrical contact between cable conducting wires was normally achieved through soldering, crimping or insulation displacement of the cables. More recently, these methods have been replaced by the penetration method which comprises the use of metal conductors in the shape of spikes, or lances to pierce the insulation sheath of the cable conductors to facilitate electrical contact between the wires, thus obviating the need to cut open, or strip the cable insulation sheathing to make the wire contacts. This method is now popularly used in both high voltage and low voltage cable connector assemblies.

Low voltage, as described herein, apply to circuits that are exempt from the protection required for line voltage circuits such as conduits, breaker panels, ground fault interrupt devices etc. Low voltage circuits require a transformer that will modify a 110 v-220 v AC input and provide a 0 v-49 v DC output current. Low voltage circuits are used in the residential and light commercial markets primarily for landscape lighting and irrigation control. Low voltage circuits can be carried on direct burial wires (DBR) which do not require the use of conduit and junction boxes for electrical connections. Typically, the DBR is a flat dual conductor with a pair of individual wires held together by a small link of insulation that can be easily separated without exposing either individual wire.

Low voltage cable connectors are generally used to join, or connect cables that are part of an outdoor lighting system. The system is typically comprised of a set of conductor cables from a source, connecting to a set of conductor cables from the lighting fixture. The source conductor is the electrical current carrying wire pair from a low voltage source (commonly the low voltage transformer) and the fixture conductor is the wire that feeds the fixture and connects to the source conductor.

The common feature of a majority of the low voltage cable connectors is in the use of a metal conductor with a sharp pointed end that penetrates or partly displaces the insulating jackets of a source conductor and a fixture conductor to bring them into electrical contact with each other. The use of such a metal conductor obviates the need to tear open, or strip a major segment of the insulation of both the source conductor and fixture conductor cables in order to bring them into electrical contact with each other.

Many of the popular brands of low voltage connectors available in the market today have significant deficiencies in their construction and operation. For example, in one of the popular brands of the low voltage connectors in the market, the metal conductor spikes used to establish the contact with the wiring within the cables is reported to have a tendency to bend, thereby limiting the connector's capability to effectively pierce the insulated sheathing of the cables to electrically connect the source conductor and the fixture conductor. Many of the most popular low voltage connectors are prone to misalignment of the metal conductor element, which prevents the conductor from making contact with the current-carrying inner metal strands of the target conductor wire. The other limiting feature of some of the low voltage connectors in the prior art are their incapacity to hold and pierce the better quality low voltage cables with a thicker insulating sheathing. A major drawback of the low voltage connectors in the prior art is in their inability to protect the connection from excessive moisture and oxygen which causes corrosion and ultimately failure of the electrical connection. Some of the low voltage connectors used for outdoor lighting and other tasks are also known to be constructed of poor quality plastic that can melt or turn brittle from prolonged exposure to the elements.

The above described deficiencies as well as others in the prior art low voltage cable connectors has prompted the need to construct a better quality cable connector that is sturdy, efficient and capable of withstanding the harsh outdoor elements. It is believed that the present invention of a cable connector with a detachable pivot shaft and pivot hub meets these needs and overcomes the deficiencies of the prior art low voltage cable connectors.

SUMMARY OF THE INVENTION

The present invention is a low voltage cable connector primarily used to connect low voltage light stranded wire fixture conductors to stranded wire source conductors.

It is an object of the present invention to provide a low voltage cable connector that has sturdy metal conductor pins capable of piercing the insulated sheathings of a source conductor and a fixture conductor of a quality gauge and thickness, with limited damage to both the source and fixture conductors upon penetration of their stranded wires.

It is a further object of the present invention to provide a low voltage cable connector that enables a water tight connection between insulated direct burial wire (DBR) pairs of varying gauges without the need to remove, cut, or strip the insulation, from either the fixture or source conductors.

The exemplary embodiment of the cable connector of the present invention, has a uniquely shaped design having a detachable base pivot hub and a top pivot shaft that can be separated completely into their respective parts and further allows them to engage and disengage an unlimited number of times. In this embodiment, the connector assembly connects two sides of a source conductor to the corresponding two fixture conductors. Further in this embodiment of the invention, the metal conductor pins used to penetrate the source and fixture conductors have a special arc design to enable accurate and easy penetration of the conductor wires. In addition, the specially designed ridges on the top and base parts of the connector assembly create a water tight seal with the source conductor insulation sheath when they are fully closed. Further in this embodiment of the invention, the interlocking guide posts in the base part and the slots in the top part fully align the metal conductor pins with the center of the source conductor and the corresponding fixture conductor as the assembly is rotated ninety degrees from the open position to the fully closed position. These interlocking posts and slots engage with sufficient friction to prevent the assembly from recoiling open and will further retain the assembly in the fully closed position in the absence of an external force which may cause the assembly to open partially or completely. In addition, the embodiments of the connector assembly have a unique shape which presents the smallest circumference of the closed assembly such that it can be permanently secured with a variety of closure devices without the possibility of the closure device sliding out of position unless it is loosened or completely detached. Such closure devices include, but are not limited to, custom designed plastic, metallic, or nylon accessories, or readily available commercial devices such as zip ties, clips, wires, tapes, and clamps.

In the exemplary embodiment of the cable connector of the present invention, the design of the connector assembly provides separate conductor wire channels which hold the wires securely in place and allow for the precise vertical penetration of the conductor pins through the source conductor and the fixture conductors. This embodiment of the cable connector of the invention, allows the use of a 12 American Wire Gauge (12 AWG) source conductor and 18 American Wire Gauge (18 AWG) fixture conductors.

In yet other embodiments of the cable connector of the present invention, the source conductor holding channels in the base part containing the pivot hub have varied widths to allow for the use of a 10 AWG source conductor as in embodiment two and/or 14 AWG and 16 AWG source conductor as in embodiment three of the invention. All embodiments of the cable connector of the present invention, allow for the use of 18 AWG or 16 AWG fixture conductors. All embodiments of the cable connector of the present invention are constructed of injection molded plastic except for the metal conductor pins.

In yet another exemplary embodiment of the invention, the base pivot hub section of the connector assembly is modified to include only the source conductor wire channel. In this embodiment of the invention, the fixture conductor wire channels form part of an insert device which is form fitted to interlock with the base pivot hub section. The two fixture conductor wire channels configured with the insert device are designed to support 16 AWG and 18 AWG fixture conductor wires. In this embodiment, the fixture conductor wires are threaded through the fixture conductor wire channels in the insert device before the insert device is locked into the base pivot hub section. In this embodiment, when the top pivot shaft section is interlocked with the base pivot hub section, the metal conductor pins on the top pivot shaft section first penetrate the fixture conductor wires placed within the fixture conductor wire channels in the insert device before penetrating the source conductor wire held in the source conductor wire channel in the base pivot hub section. In this embodiment of the invention, the metal conductor pins are not bent into an arc shape as in the previous embodiment where the pins have to penetrate into the thicker source conductor wire first before penetrating the smaller fixture conductor wires. Rather, the metal conductor pins in this embodiment have a straight shape since they will be penetrating the smaller fixture conductor wires first before penetrating the source conductor wire. The use of the insert device configured with the fixture conductor wire channels eliminates the need for fixture conductor wire channels to be molded to the base pivot hub section.

The objects, embodiments and features of the cable connector of the present invention as described in this summary of the invention will be further appreciated and will become obvious to one skilled in the art when viewed in conjunction with the drawings, detailed description of the invention and the appended claims.

In this summary of the cable connector of the present invention describing the objects and embodiments of the invention and in the specification in general, references to "the exemplary embodiment, "yet another exemplary embodiment", or "yet other embodiments" do not necessarily all refer to the same embodiment(s). Rather, the references to the various embodiments mean that a particular feature, structure, or characteristics described in conjunction with a specific embodiment is included in at least some embodiments, but not necessarily all embodiments of the invention.

DETAILED DESCRIPTION OF THE INVENTION

The present invention is a cable connector assembly with a detachable pivot shaft and pivot hub to connect the primary 0 v-49 v DC direct burial source conductor (DBR) to fixture conductors used in outdoor lighting and irrigation systems. The exemplary embodiment of the invention has fixture conductor channels molded into the base pivot hub section of the connector assembly. In yet another exemplary embodiment of the invention, an insert device is configured with the fixture conductor wire channels to hold the fixture conductor wires on the base pivot hub section above the source conductor wire held in the source conductor wire channel at the bottom of the base pivot hub section of the connector assembly.

Figure 1:
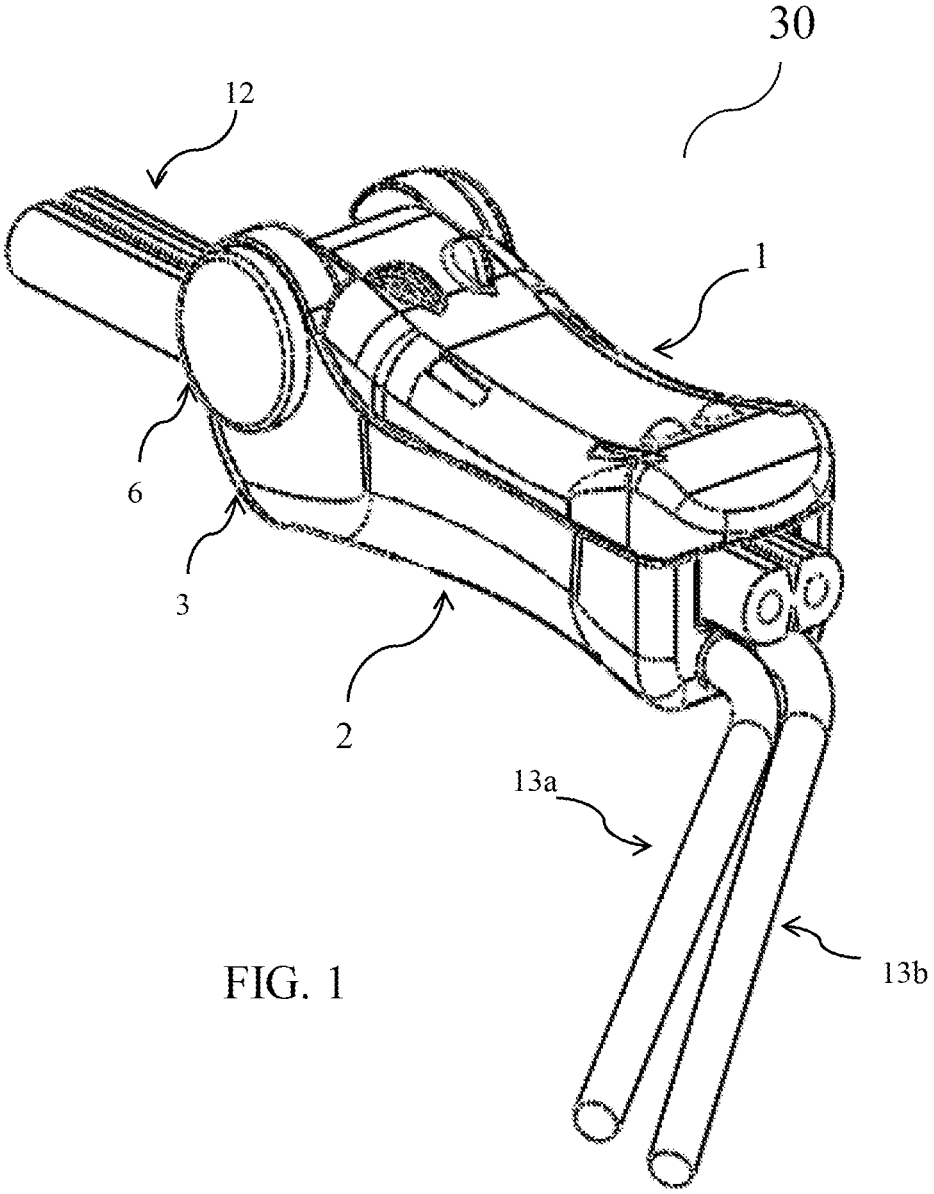
FIG. 1 is a perspective view of the exemplary embodiment of the cable connector assembly of the present invention.

Referring now to the drawings, more particularly to FIG. 1 a perspective view of the exemplary embodiment of the cable connector 30 of the present invention is shown having a unique alligator design. In this embodiment of the cable connector 30 shown in the closed configuration, the interlocking guide posts and slots (not seen) are fully aligned, holding a top pivot shaft section 1 and a base pivot hub section 2 together with friction, as the parts fit together with zero tolerance between the guide posts on the base pivot hub section 2 and the slots on the top pivot shaft section 1 (not seen in this figure). FIG. 1 further shows the unique design of the cable connector 30 with the smallest circumference of the closed assembly presented in the mid section of the device which enables the use of a closure device to achieve permanent closure of the assembly. The protruding eyes and nostrils of the alligator shape of the cable connector 30 besides augmenting the visual and aesthetic appeal of the connector assembly also have a functional role in positioning a closure device around the mid section of the connector assembly. In this perspective view of the exemplary embodiment of the cable connector 30 which is shown in its functional closed position, a source conductor 12 and a pair of fixture conductors 13*a* and 13*b* are seen inserted into the base pivot hub section 2 with the source conductor 12 lying parallel on top of the fixture conductors 13*a* and 13*b* which are placed into the conductor channels (not seen in this view) molded into the base pivot hub section 2. In this closed position of the connector assembly 30 the metal conductor pins (not seen) which are molded on the inside at the top end of the top pivot shaft section 1 would have penetrated the source conductor 12 and the pair of fixture conductors 13*a* and 13*b* to provide the electrical connection between the sets of wires within the source conductor and the fixture conductors. In addition to positioning the source conductor 12 and fixture conductors 13*a* and 13*b* for accurate and effective penetration of the metal conductor pins (not shown) upon closure, the placement of the fixture conductors 13*a* and 13*b* below the uncut source conductor 12 in the closed assembly of the cable connector 30 serves to protect the smaller and less durable fixture conductors 13*a* and 13*b* from damage or displacement risks present in the harsh outdoor environment.

Figure 2:
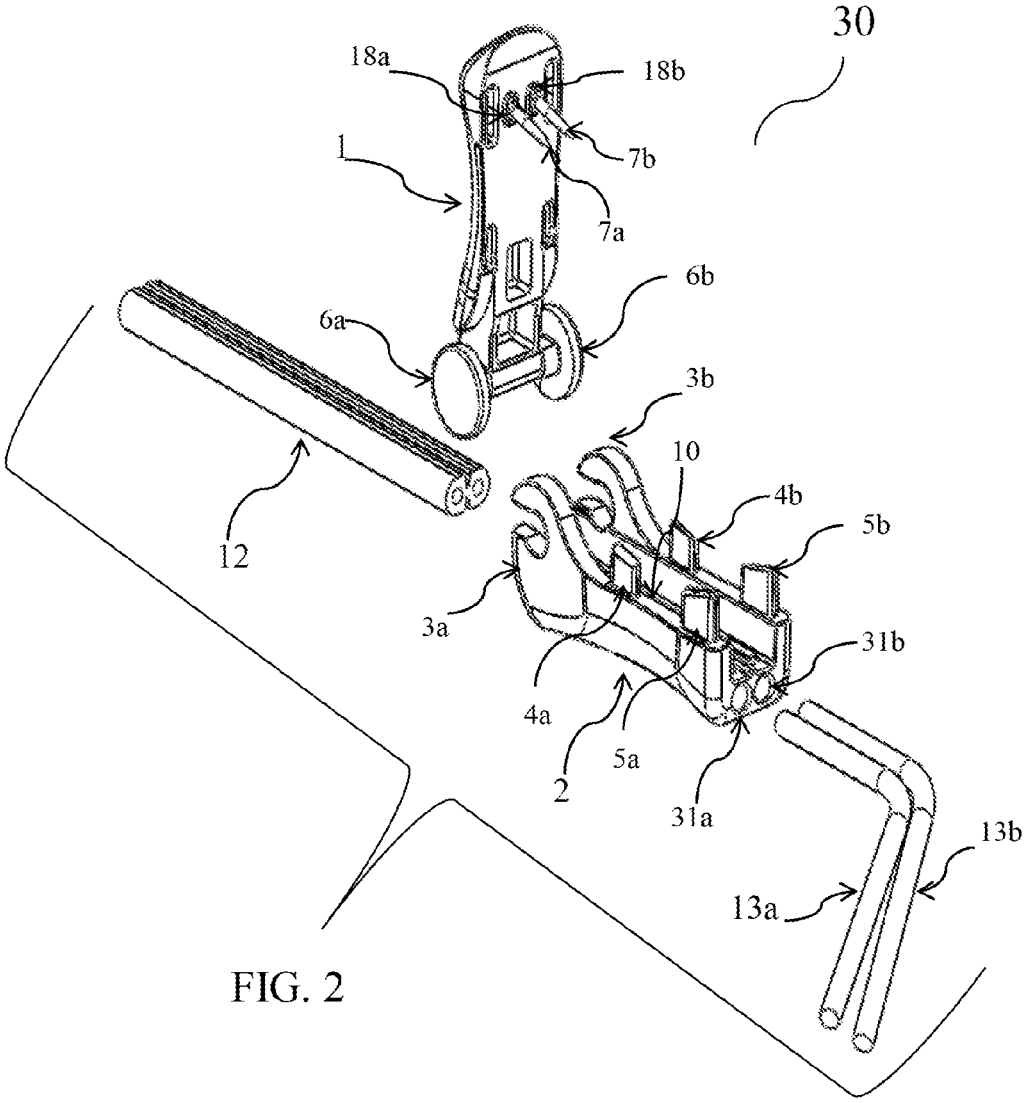
FIG. 2 is an exploded view of the exemplary embodiment of the cable connector assembly of the present invention with the top pivot shaft section separated from the base pivot hub section having the fixture conductor wire channels molded into the base.

Referring now to FIG. 2 an exploded view of the cable connector 30 is shown. This view shows the top pivot shaft section 1 separated from the base pivot hub section 2. In this view, the source conductor 12 and the fixture conductors 13*a* and 13*b* are seen placed alongside the base pivot hub section 2. In this embodiment, the source conductor 12 is a standard, 12 American Wire Gauge (AWG), direct burial wire (DBR). The fixture conductors 13*a* and 13*b* have wires that are standard 18 AWG and fit exactly into the fixture conductor channels 31*a* and 31*b* respectively. The fixture conductor channels 31*a* and 31*b* allow the fixture conductors 13*a* and 13*b* to slide in approximately 20 mm and position directly under the metal pin conductor slots (not seen) in the base pivot hub section 2. In the exemplary embodiments of the connector assembly, the round metal conductor pins 7*a* and 7*b* are 1.52 mm×14 mm and in all embodiments the round metal conductor pins 7*a* and 7*b* are shaped to a fine point for precision piercing of the stranded electrical cable wires. Each 7*a* and 7*b* round metal conductor pin is attached to pin molds 18*a* and 18*b* respectively on the inside top end of the top pivot shaft section 1. The pin molds, 18*a* and 18*b* have raised ridges to compress into the source conductor insulation sheath upon closure to create a water tight seal with the source conductor 12.

In all embodiments, the unique shape and profile of the top pivot shaft section 1 supports use of a closure device that will not slip away from the mid section holding the parts when closed in full assembly. The top pivot shaft section 1 also has interlocking guide slots which mate precisely with the interlocking guide posts 4*a*, 4*b*, 5*a* and 5*b* on the base pivot hub section 2. A pivot shaft at the base of the top pivot shaft section 1 is shaped to slide into the base pivot hub section 2 pivot hub sockets 3*a* and 3*b* when the top pivot shaft section 1 is aligned at 90° to the base pivot hub section 2. Pivot shaft caps 6*a* and 6*b* align the top pivot shaft section 1 to the base pivot hub section 2 when the top pivot shaft section 1 is aligned at 90° to the base pivot hub section 2 and inserted laterally. Cavities on the inside surface of the top pivot shaft section 1 are created to reduce the material in the plastic mold and retain strength and stiffness of the parts. A source conductor channel 10 supports different wire gauges for the various embodiments of the cable connector assembly of the present invention. The pivot hub sockets 3*a* and 3*b* have a special design that allows the top pivot shaft section 1 to slide smoothly and effortlessly into the base pivot hub section 2 when the top pivot shaft section 1 is at a 90° angle to the base pivot hub section 2 and facilitates the top pivot shaft section 1 to rotate 90° to a fully closed position. When the top pivot shaft section 1 is initially rotated 5° toward closure, the top pivot shaft section 1 with the pivot shaft is locked into the base pivot hub section 2 and cannot be removed from the base pivot hub section 2 preventing the two from separating or even moving forward, aft, or deflecting side to side which would cause misalignment of the conductor pins 7*a* and 7*b* with the corresponding center of the source conductor 12 and the fixture conductors 13*a* and 13*b*. By, confining and isolating the fixture conductors 13*a* and 13*b* they are always targeted precisely for the penetration of the metal conductor pins 7*a* and 7*b* resulting in the pins passing vertically into the two sets of wires when the connector assembly is in a closed position.

Figure 3:
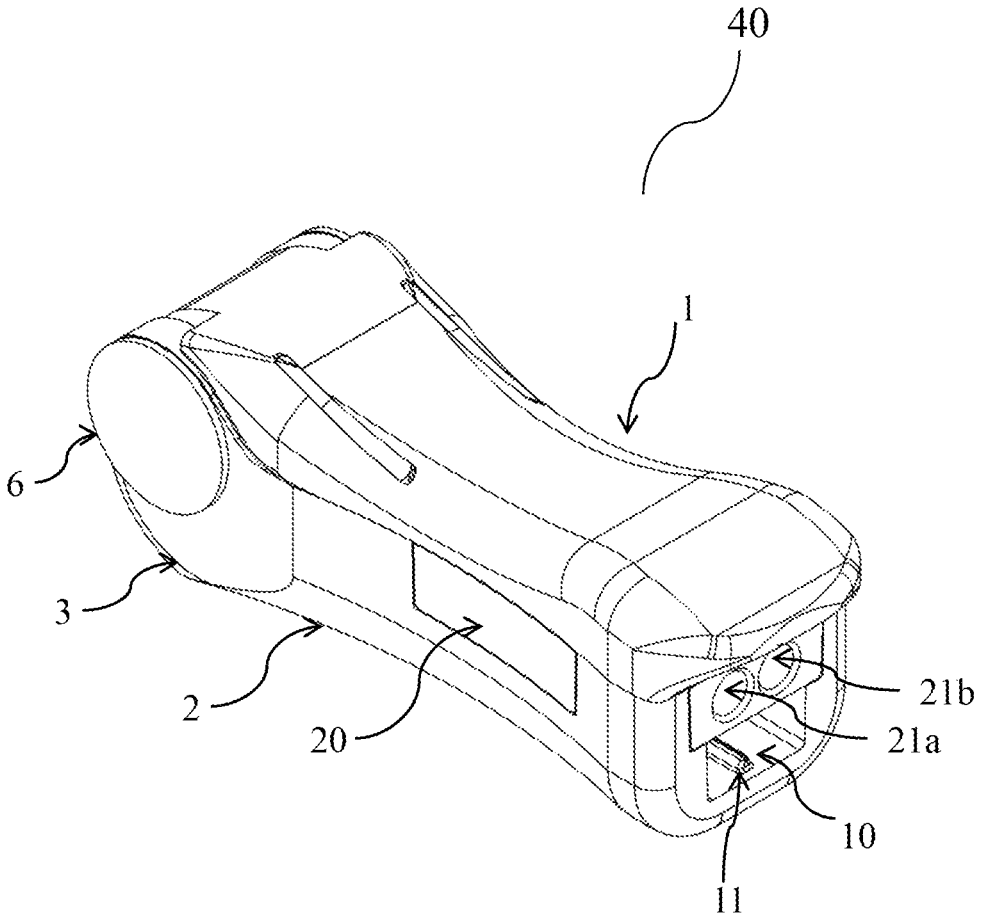
FIG. 3 is a perspective view of yet another exemplary embodiment of the present invention that uses an insert device configured with the fixture conductor wire channels.

Referring now to FIG. 3 another exemplary embodiment of the cable connector 40 is shown. In this embodiment, the base pivot hub section 2 does not have the fixture conductor wire channels molded into its base. Rather, an insert device 20 configured with the fixture conductor wire channels 21*a* and 21*b* holds the fixture conductor wires and is placed between the top pivot shaft section 1 and the base pivot hub section 2. The top pivot shaft section and the base pivot hub section of the exemplary embodiment of the connector assembly described in FIG. 1 and FIG. 2 are modified in this embodiment of the invention to better accommodate the insert device 20 while retaining the utility of the embodiment described in these figures. Specifically, the base pivot hub section 2 is redesigned to be larger which allows for a smoother exterior profile when mated with the top pivot shaft section upon full closure. In this embodiment, the pivot shaft caps 6 one on either side of the top pivot shaft section 1 are redesigned to create a smoother profile when the top pivot shaft section 1 is mated with the base pivot hub section 2. In this embodiment, although the pivot hub arms 3 one on either side of the back end of the based pivot hub section 2 have the same utility as compared to the previous embodiment described in FIG. 1 and FIG. 2 they are slightly larger and thicker in this embodiment for added strength and durability. Upon full assembly of the three components, the top pivot shaft section 1, the insert device 20 and the base pivot hub section 2, the connector assembly retains the smooth exterior profile of the previous embodiment that allows for use of a zip tie, clip, tape, or clamp to secure the assembly so that it is completely closed and water tight.

In this exemplary embodiment of the connector assembly, the source conductor wire is placed in the source conductor channel 10 which is situated below the fixture conductor wires held in the fixture conductor wire channels 21*a* and 21*b* in the insert. In this embodiment of the invention, the metal conductor pins have a straight shape for easy penetration of the smaller fixture conductor wires. In this embodiment, when the top pivot shaft section 1 is interlocked with the base pivot hub section 2 the metal conductor pins (not shown here) will first penetrate the fixture conductor wires and then the source conductor wire placed in the source conductor channel 10. This modified design allows for complete penetration of the fixture conductor wires by placing them above the source conductor wire, with the additional benefit of partial penetration of the source conductor wire which avoids the potential for damage or corrosion to the wire. In this embodiment of the cable connector 40 shown in the closed configuration, the interlocking guide posts and slots (not seen) are fully aligned, holding the top pivot shaft section 1 and the base pivot hub section 2 together with friction, as the parts fit together with zero tolerance between the guide posts on the base pivot hub section 2 and the slots on the top pivot shaft section 1. The tapered profile of the connector assembly provides the same utility as the original design as shown in FIG. 1 and FIG. 2 and insures consistent secure closure of the connector assembly.

Figure 4:
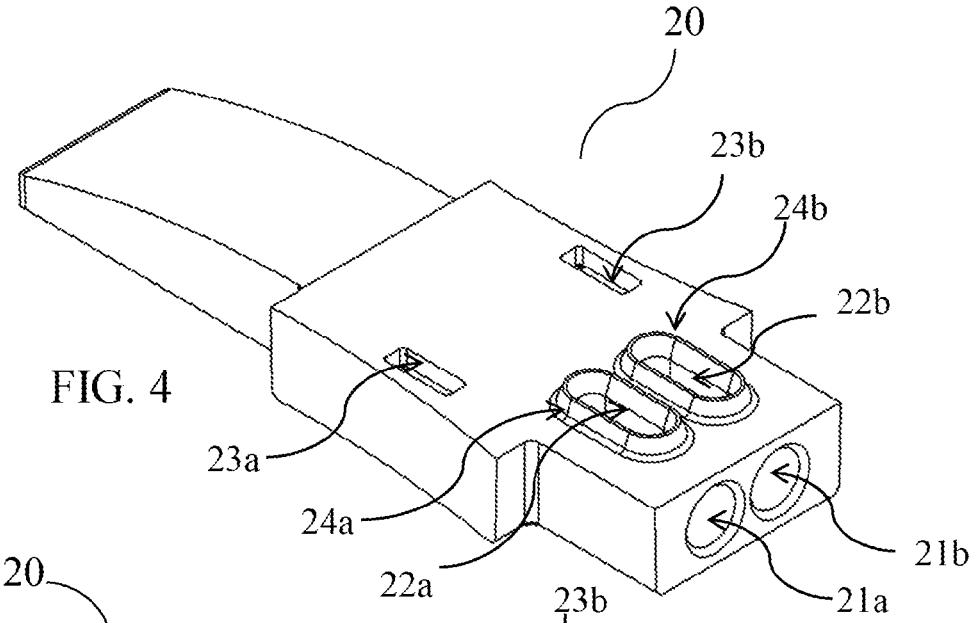
FIG. 4 is a perspective view of the insert device configured with the fixture conductor wire channels.

FIG. 4 is a perspective view of the insert device 20. The insert device 20 is configured with two fixture conductor wire channels 21*a* and 21*b* through which the fixture conductor wires are threaded before the insert device 20 is locked into the base pivot hub section of the connector assembly. The fixture conductor channels 21*a* and 21*b* are designed to support a 16 AWG and/or a 18 AWG fixture conductor wires. The fixture conductor channels are designed to position the fixture conductor wires in the direct center and insure penetration of the conductive copper core by the metal conductor pins which are molded into the inside top end of the top pivot shaft section of the connector assembly. The fixture conductor wire channels 21*a* and 21*b* in the insert 20 are of sufficient size to allow partial fill with silicone grease. The insert device 20 is configured with voids 23*a* and 23*b* designed to be inserted with only one possible orientation when mated with the specially designed tangs on the base pivot hub section. In this view of the insert 20 the pin windows 22*a* and 22*b* are configured to hold the metal conductor pins. The ridges 24*a* and 24*b* around the pin windows are designed to interlock with the recessed rings around the molds for the metal conductor pins on the inside surface of the top end of the top pivot shaft section. Upon insertion of the fixture conductor wires, the silicone grease is dispersed around the wire casing and protrudes out of the pin window above and below the fixture conductor wires.

Figure 5:
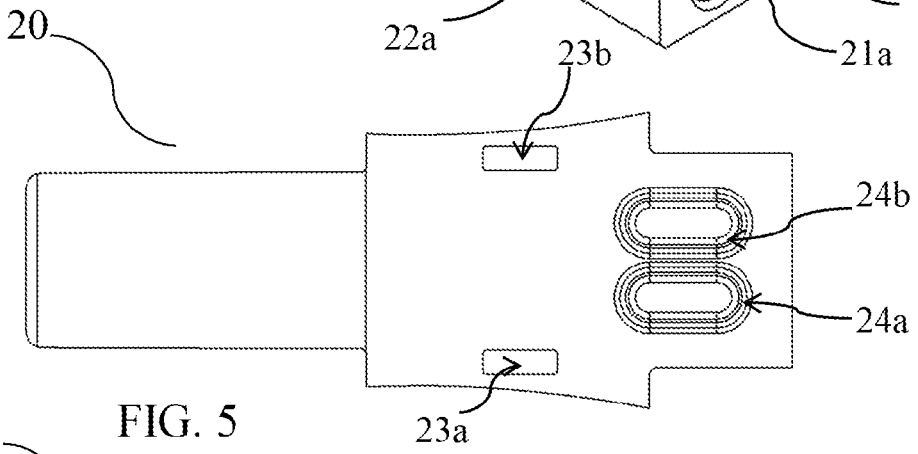
FIG. 5 is a top plan view of the insert device.

FIG. 5 is a top plan view of the insert device 20 showing another view of the top ridges 24*a* and 24*b* and the voids 23*a* and 23*b* that interlock with the tangs on the base pivot hub section of the connector assembly. Upon full closure of the connector assembly, the top ridges 24*a* and 24*b* interlock with the inside of the top pivot shaft section and the silicone grease that protrudes above the fixture conductor wires fills the recessed voids on the bottom part of the top pivot shaft section to create a water tight seal.

Figure 6:
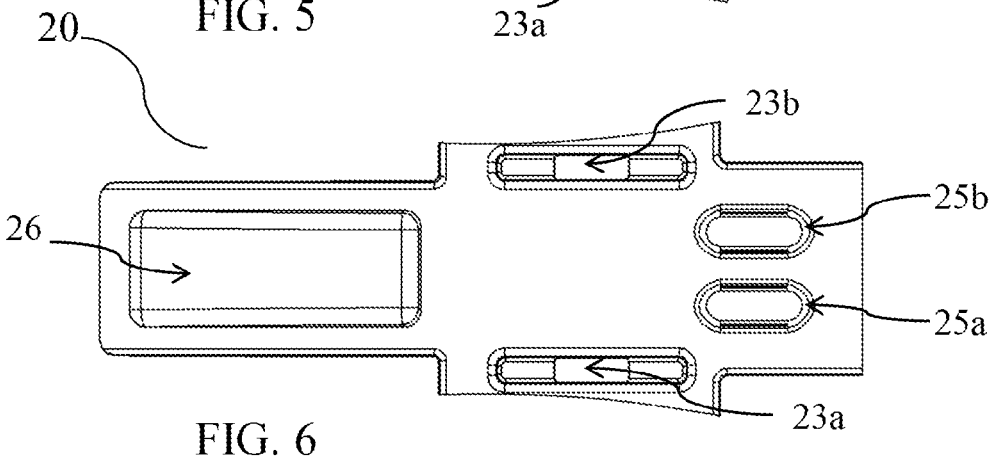
FIG. 6 is a bottom plan view of the insert device.

FIG. 6 is a bottom plan view of the insert device 20. The ridges 25*a* and 25*b* on the bottom of the insert device 20 have sharp edges which upon closure of the connector assembly compresses the plasticized insulation of the source wire in the source wire channel that is at the bottom of the base pivot hub section of the connector assembly. The view also shows the bottom of the voids 23*a* and 23*b* which interlock with the mid section tangs on the base pivot hub section with moderate friction hold between the two parts. There is a mass reduction cavity 26 at the narrow end of the insert device 20. In general, the mass reduction cavity 26 and other voids in the different parts of the connector assembly help in reducing the weight of the connector assembly, thereby reducing the shipping cost as well as manufacturing cost.

Figure 7:
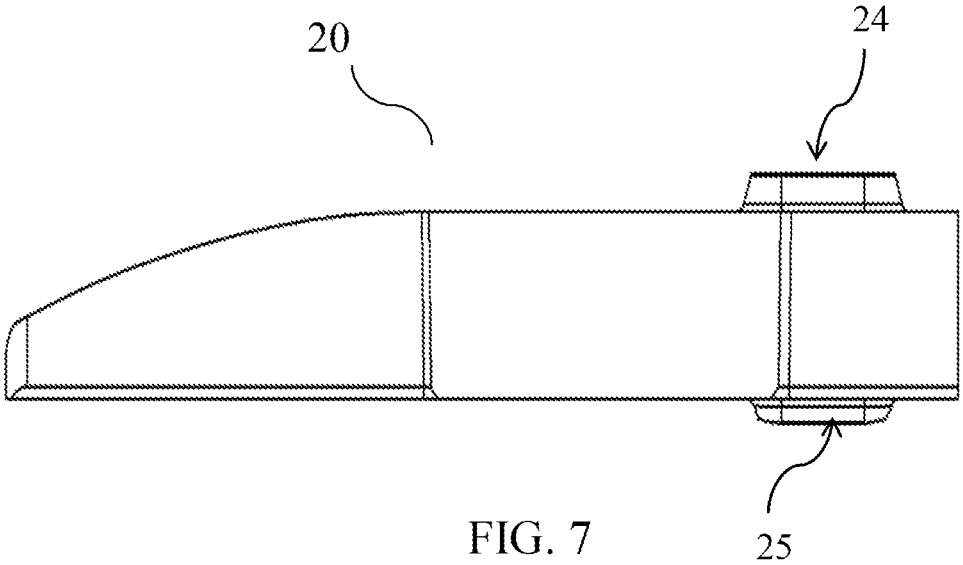
FIG. 7 is a side view of the insert device.

FIG. 7 is a side view of the insert device 20 showing the top ridge 24 and the bottom ridge 25. Each of these ridges comprise of a pair lying on either side of the wide body of the insert device 20.

Figure 8:
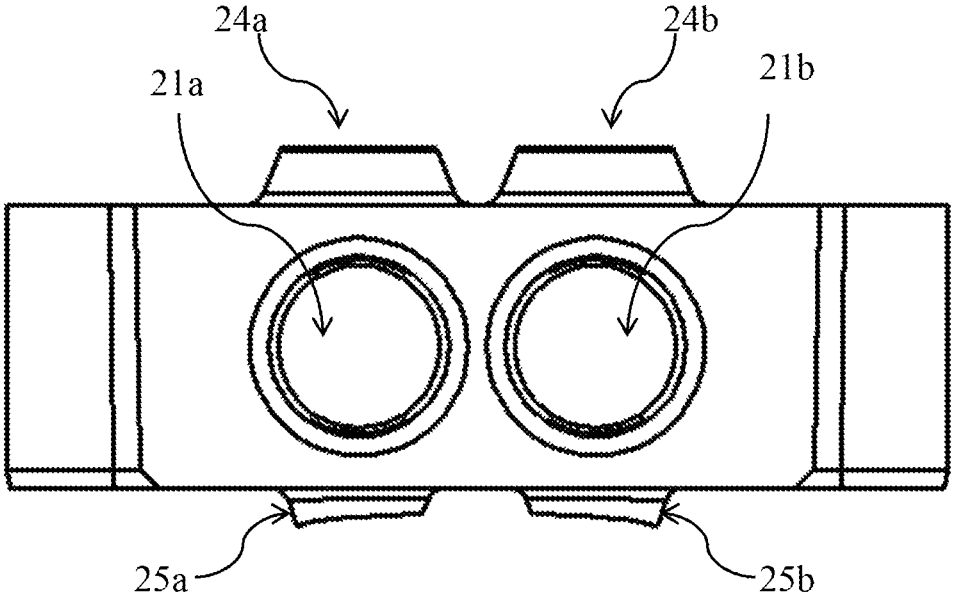
FIG. 8 is a front perspective view of the insert device showing the openings to the fixture conductor wire channels.

FIG. 8 shows a view from the front of the insert device 20. The top ridges 24*a* and 24*b* interlock with the recessed rings around the pin molds on the top pivot shaft section of the assembly. The bottom ridges 25*a* and 25*b* having sharp edges compress into the plasticized insulation of the source conductor wire in the source wire channel located at the bottom of the base pivot hub section of the assembly. The fixture conductor wire channels 21*a* and 21*b* hold the fixture conductor wires above the source conductor wire in the source conductor channel at the bottom of the base pivot nub section of the connector assembly.

Figure 9:
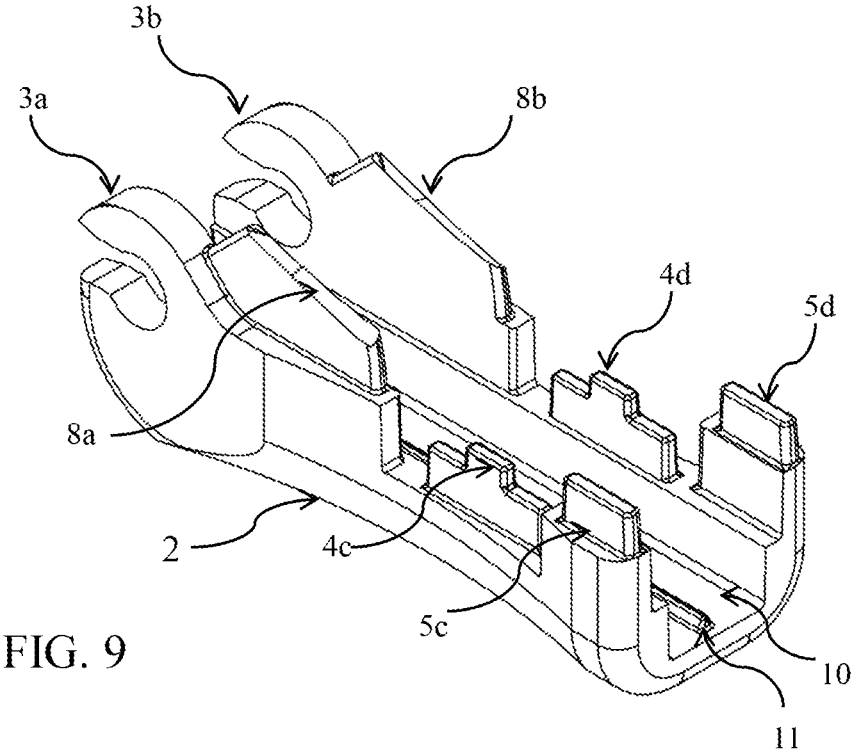
FIG. 9 is a perspective view of the modified base pivot hub section without the fixture conductor wire channels.

FIG. 9 is a perspective view of the modified base pivot hub section 2 of the connector assembly. The base pivot hub 2 has the same utility of the original design of the exemplary embodiment shown in FIG. 1 and FIG. 2. The pivot hub sockets 3*a* and 3*b* are larger and thicker than the other embodiment for added strength to hold the insert device. The rear tangs 8*a* and 8*b* have the same utility as the original design, but have been modified to insure proper alignment with the modified top pivot shaft section of the connector assembly and enable guiding of the top section closure at 5 degrees of rotation from the 90 degree insert position. The front tangs 5*c* and 5*d* are modified and are smaller to match the smaller voids in the top pivot shaft section of the assembly. These front tangs do not protrude through the exterior profile of the top pivot shaft section upon closure of the connector assembly. The function of the front tangs 5*c* and 5*d* are to guide the last 10 degrees of closure while providing a friction hold of the top pivot shaft section to the base pivot hub of the connector assembly to accommodate the zero tolerance design of the two parts of the connector assembly. The mid section tangs 4*c* and 4*d* allow for the complete seating of the insert device in only one orientation. Each of these tangs are designed with a slight negative tolerance being slightly larger than the voids on the insert device so that when the insert device is seated into the base pivot hub section, it is held firmly in place on the base pivot hub section. The assembly of the insert device and the base pivot hub section provides for a simple, but effective alignment of the fixture conductor wires directly above the center of the source conductor wire and does not interfere with the top pivot shaft section in any manner. The source wire channel 10 and the center ridge 11 of the modified base pivot hub 2 retain the same utility as they do in the original base pivot hub section of the connector assembly.

Figure 10:
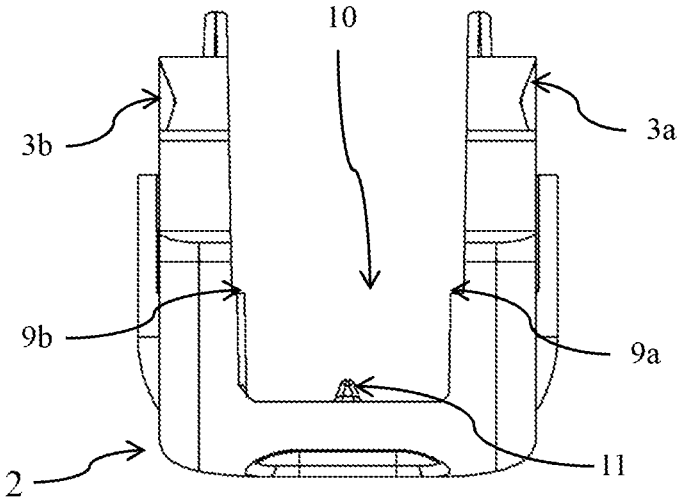
FIG. 10 is a view from the back of the modified base pivot hub section.

FIG. 10 is a view from the back of the modified base pivot hub section showing the modified source wire channel 10 and the center ridge 11 along with back views of the pivot hubs 3*a* and 3*b*. The modified base pivot hub section 2 also has ledges 9*a* and 9*b* to allow the insert device to sit above the source wire channel 10.

Figure 11:
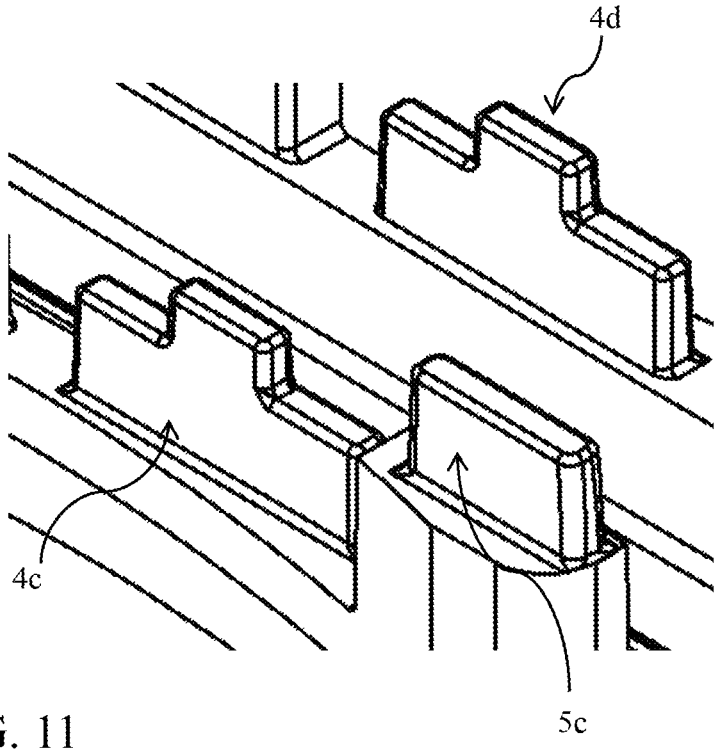
FIG. 11 is a close up cutaway side angle view of the forward tangs on the base pivot hub section to lock in the insert device to the base pivot hub section.

FIG. 11 is a close up cutaway side angle view of the modified forward tangs 4*c*, 4*d* and 5*c* on the base pivot hub section that help to lock in the insert device to the base pivot hub section.

Figure 12:
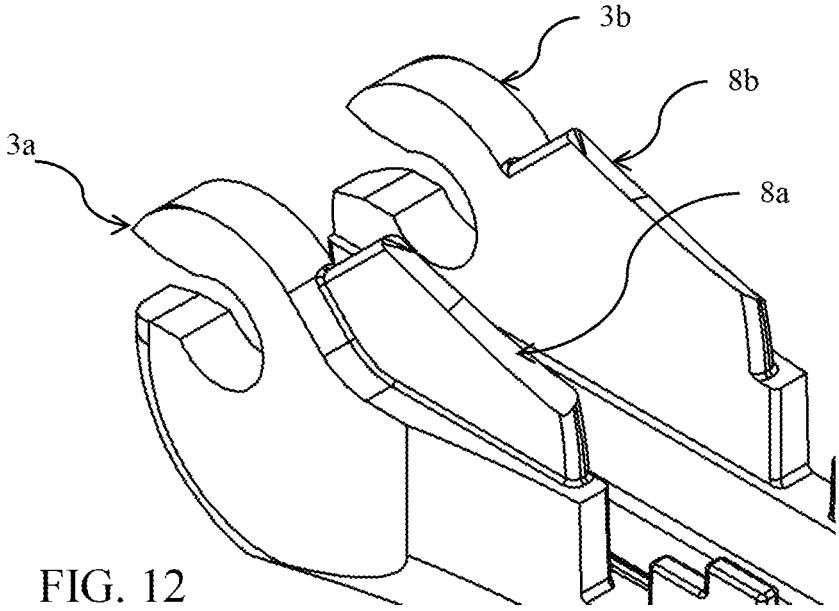
FIG. 12 is a close up cutaway side angle view of the rear tangs on the base pivot hub section to lock in the insert device to the base pivot hub section.

FIG. 12 is a close up cutaway side angle view of the rear tangs 8*a* and 8*b* on the base pivot hub section that help to lock in the insert device to the base pivot hub section. The modified larger pivot hubs 3*a* and 3*b* can also be seen in this view.

Figure 13:
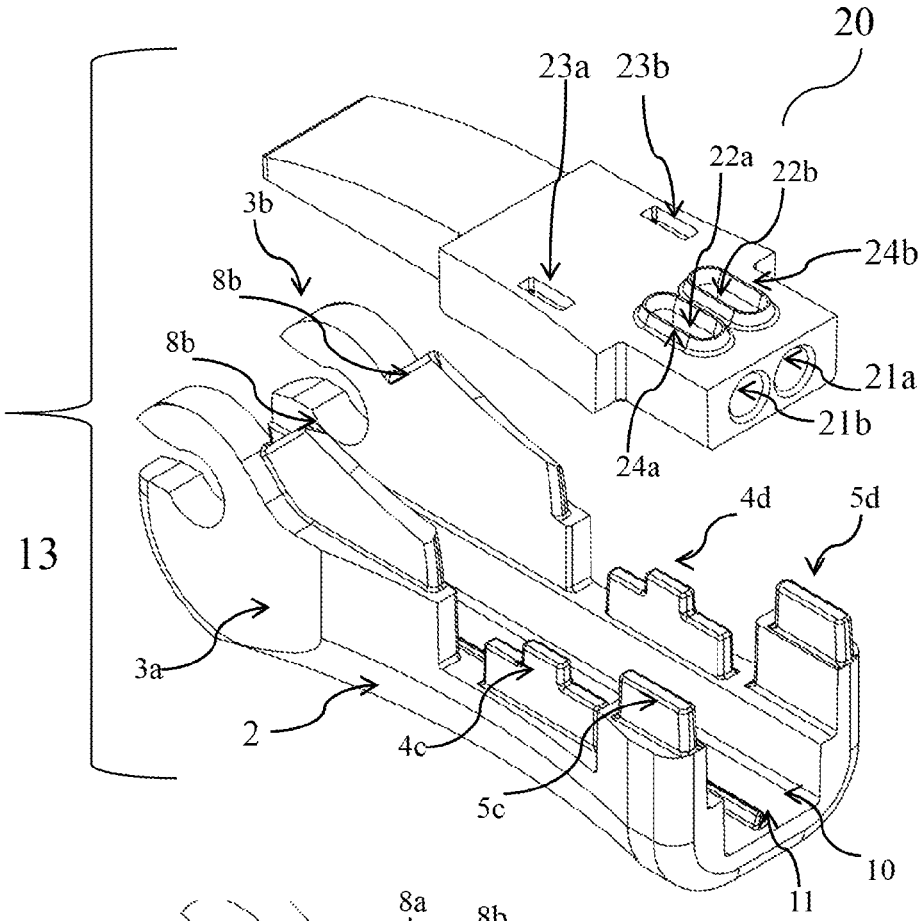
FIG. 13 is an exploded view of the insert device and the base pivot hub section before the insert device is placed within the base pivot hub section and locked into place inside the base pivot hub section.

FIG. 13 is an exploded view of the modified base pivot hub 2 and the insert device 20 before the insert device 20 is locked in to the base pivot hub section 2. The base pivot hub section 2 has modified pivot hub sockets 3*a* and 3*b*, rear tangs 8*a* and 8*b*, the mid section tangs 4*c* and 4*d*, the front tangs 5*c* and 5*d*, the center ridge 11 and the source wire channel 10. The insert device 20 has the fixture conductor wire channels 21*a* and 21*b*, the pin windows 22*a* and 22*b*, the top ridges 24*a* and 24*b*, and the voids, 23*a* and 23*b*.

Figure 14:
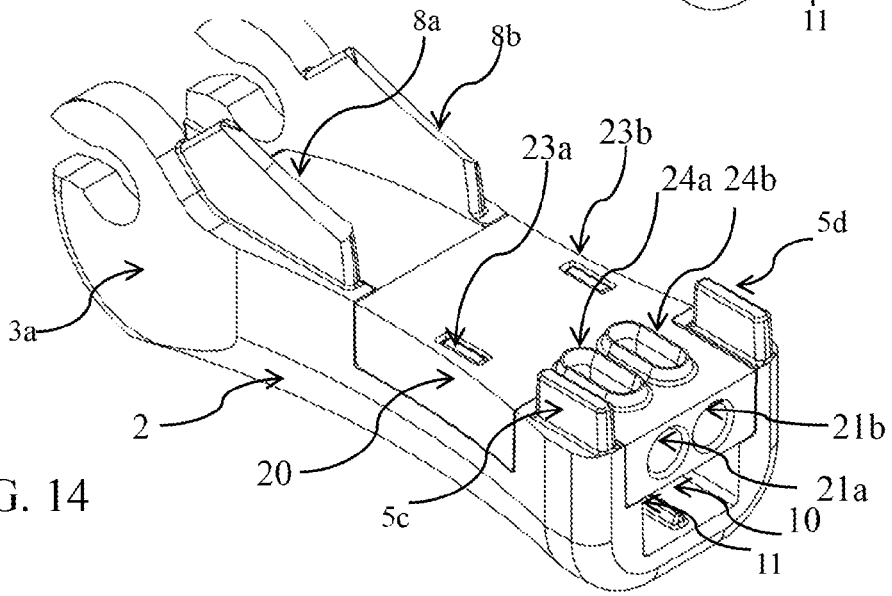
FIG. 14 is a perspective view of the base pivot hub section with the insert device interlocked with the base pivot hub section.

FIG. 14 shows a perspective view of the base pivot hub section 2 with the insert 20 securely held in place with its narrow end lying within the rear tangs 8*a* and 8*b* and its broad end over the mid section tangs (not seen here) and held within the front tangs 5*c* and 5*d*. The voids 23*a* and 23*b* sit over the mid section tangs 4*a* and 4*b* (not seen here). The top ridges 24*a* and 24*b* will interlock with the recessed rings around the metal conductor pin molds on the top pivot shaft section. The fixture conductor wires are placed inside the fixture conductor channels 21*a* and 21*b* before the insert device 20 is pressed into the base part to fit snugly between the tangs. When the insert device 20 is thus locked in with the base pivot hub section 2 the fixture conductor channels 21*a* and 21*b* are held over the source conductor channel 10.

Figure 15:
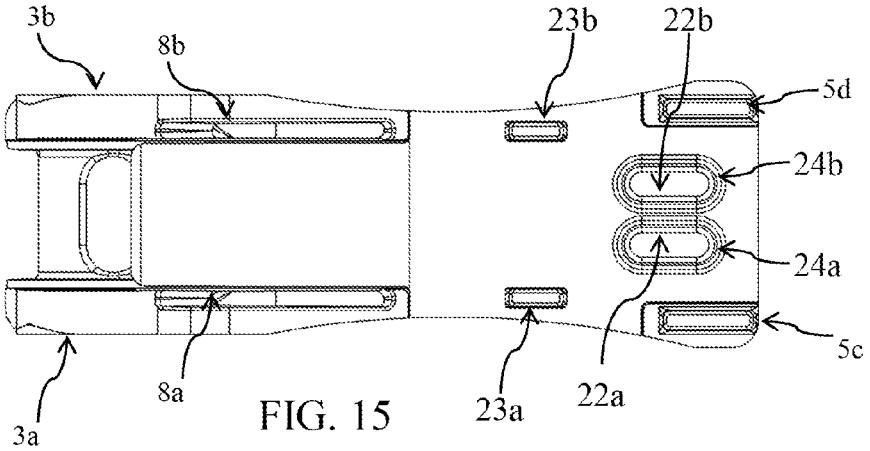
FIG. 15 is a top plan view of the insert device locked into place on the base pivot hub section.

FIG. 15 is a top plan view of the insert device 20 locked into place on the base pivot hub section illustrating the positions of the pivot hub sockets 3*a* and 3*b*, the rear tangs 8*a* and 8*b*, the voids 23*a* and 23*b*, the front tangs 5*a* and 5*b* and the pin windows 22*a* and 22*b*, and the top ridges 24*a* and 24*b*.

Figure 16:
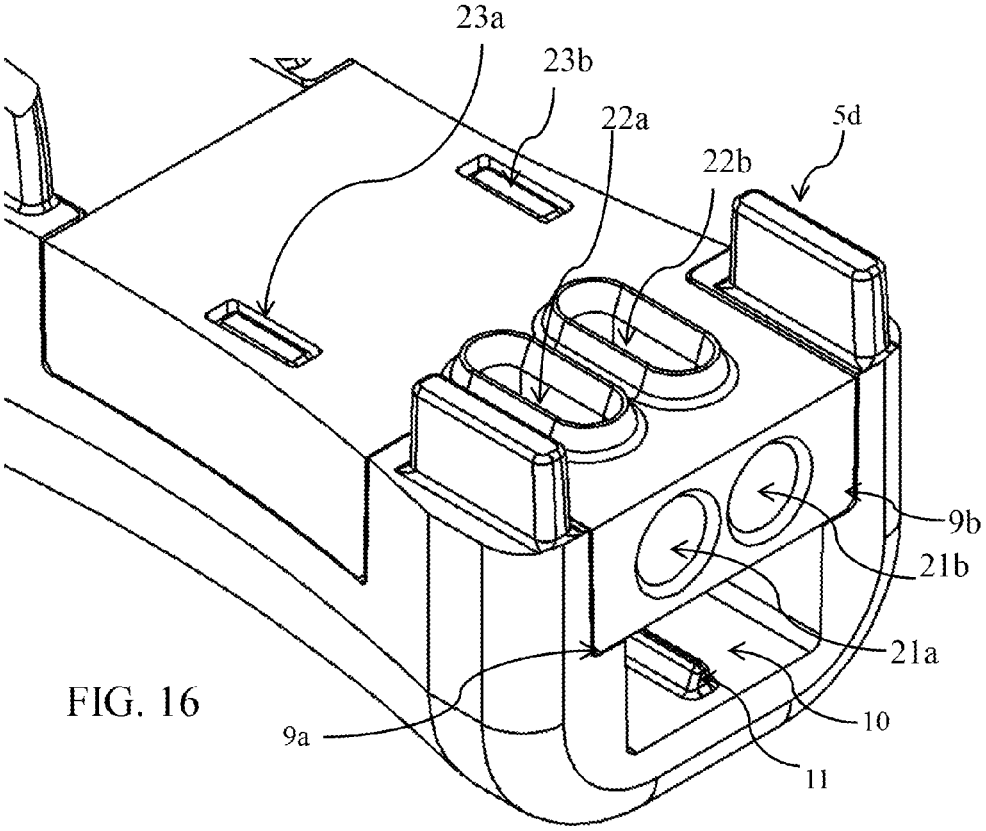
FIG. 16 is a close up perspective view of the front end of the base pivot hub section after the insert device is locked into place on the base pivot hub section.

FIG. 16 is a close up perspective view of the front end of the base pivot hub section 2 after the insert device 20 is locked into place on the base pivot hub section 2. The insert ledges 9*a* and 9*b* allows for the positive seating of the insert over the base pivot shaft section.

Figure 17:
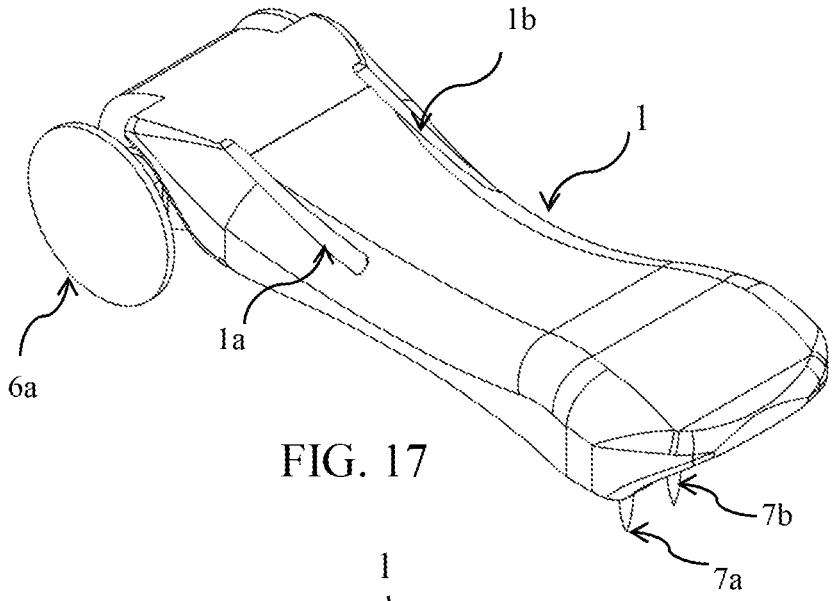
FIG. 17 is a perspective view of the top pivot shaft section of the connector assembly.

FIG. 17 is a perspective view of the top pivot shaft section 1 of the connector assembly which also has the modified pivot shaft cap 6*a* with an identical cap on the other side (not seen here). The modified top pivot shaft section 1 also has modified voids 1*a* and 1*b* to engage the base part tangs so that the two parts are interlocked together securely. The round metal conductor pins 7*a* and 7*b* seen protruding through the base of the top pivot shaft section 1 are molded into the base at the top end of the top pivot shaft section 1 with recessed rings around the molds to interlock with the ridges on the top part of the insert device. Upon closure of the assembly, the metal conductor pins 7*a* and 7*b* penetrate the fixture conductor wires through the pin windows and into the source wire held in the source wire channel in the base pivot hub section. The recessed rings and the corresponding ridges on the insert device form a water tight seal when the connector assembly is fully closed. The specially designed pivot shafts and pivot caps on the top pivot shaft section 1 allow it to be completely separated from the base pivot hub section or secured in place by inserting a 90 degree angle to the base and rotated 90 degrees to full closure.

Figure 18:
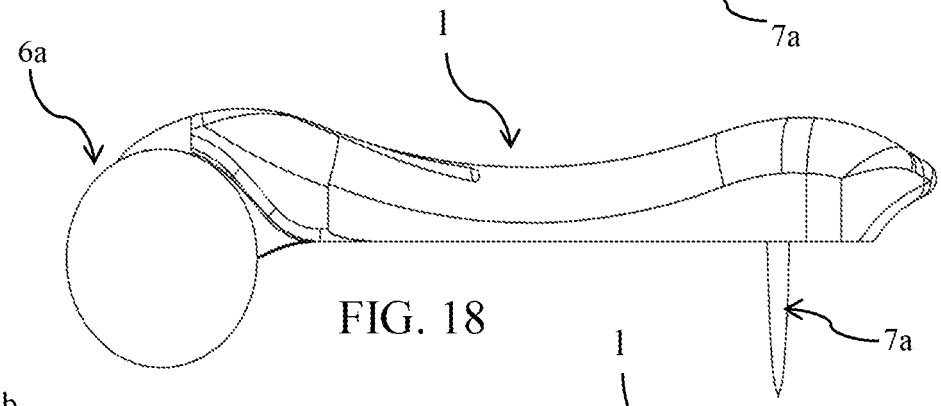
FIG. 18 is a perspective side view of the top pivot shaft section.

FIG. 18 is a side view of the top pivot shaft section 1 of the connector assembly, in particular illustrating the ergonomic design of the section. The placement of the metal conductor pins 7 are modified to fit in with the modified design of the base pivot hub and the top pivot shaft sections while the utility of the pin remains the same as before.

Figure 19:
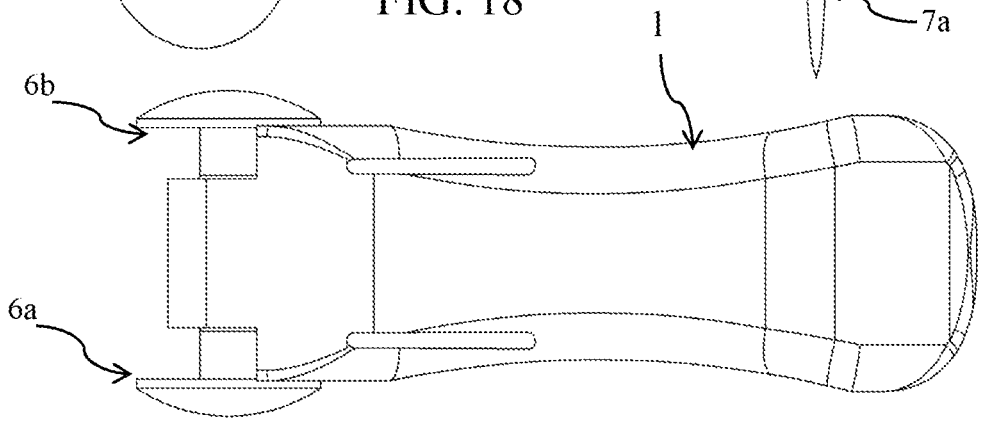
FIG. 19 is a top plan view of the top pivot shaft section.

FIG. 19 is a top plan view of the top pivot shaft section 1 with the modified design of the pivot shaft caps 6*a* and 6*b*.

Figure 20:
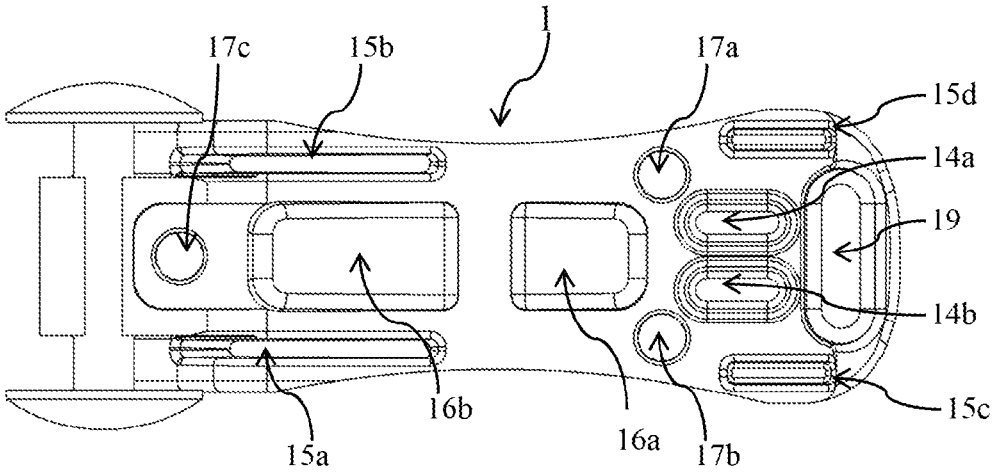
FIG. 20 is a perspective view of the bottom part of the top pivot shaft section.

FIG. 20 is a perspective view of the bottom part of the top pivot shaft section 1 that engages with the base pivot hub. In this view, 15*c* and 15 *d* are front voids to mate with the base pivot hub section front tangs 5*c* and 5*d* (not seen here) and rear voids 15*a* and 15*b* to mate with the base pivot hub rear tangs 8*a* and 8*b* (not seen here). The recessed rings 14*a* and 14*b* which encircle the mold around the metal conductor pins align with the top ridges on the insert device. Upon closure of the connector assembly the ridges on the insert device interlock with the recessed rings 14*a* and 14*b* and the silicone grease that protrudes above the fixture conductor wires fills the recessed voids and the ridge interlock to create a water tight seal. In this view, 16*a* and 16*b* are mass reduction cavities to reduce the weight of the assembly for shipment. The void 19 positioned at the front end of the top pivot shaft section 1 is uniquely shaped to allow for opening the connector assembly after full closure. Void 19 provides a point of leverage where a finger nail or other tool can be partially inserted under the top pivot shaft section 1 above the insert device to peon the connector assembly. In this view 17*a*, 17*b* and 17*c* are cylindrical voids which function to provide both mass reduction and for the positioning of parts in a fixed orientation for post production processing.

Figure 21:
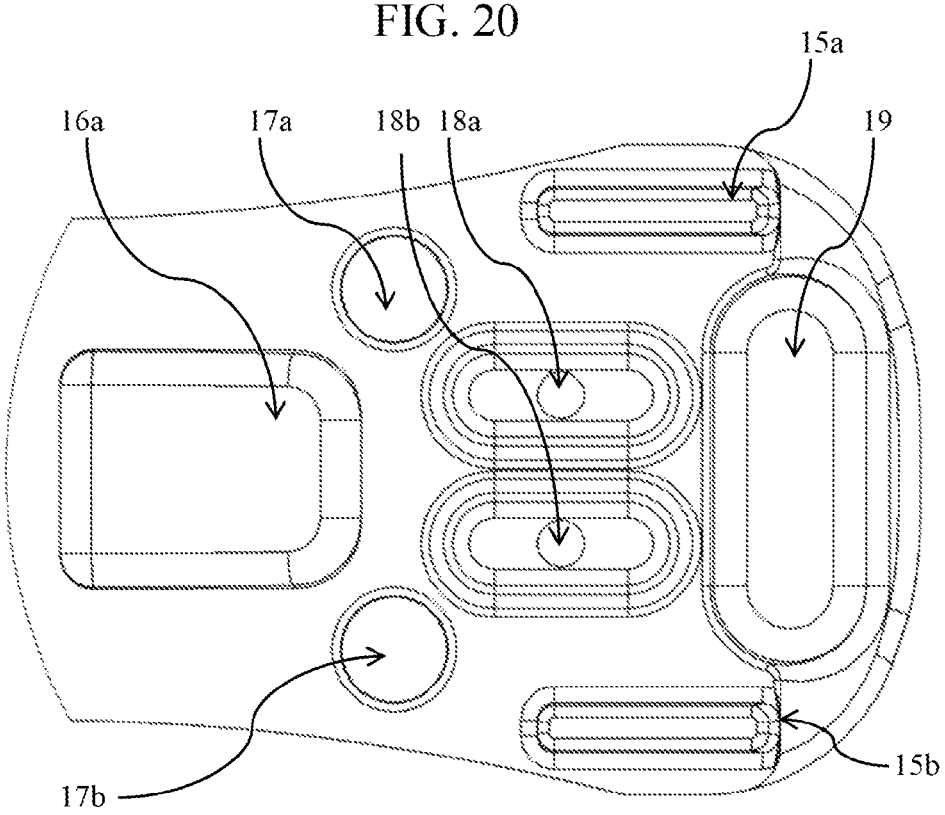
FIG. 21 is a close up view of the bottom part of the front end of the top pivot shaft section.

FIG. 21 is a close up view of the bottom part of the front end of the top pivot shaft section 1 showing in addition the pin molds 18*a* and 18*b* that hold the metal conductor pins at the top end of the top pivot shaft section 1.

Figure 22:
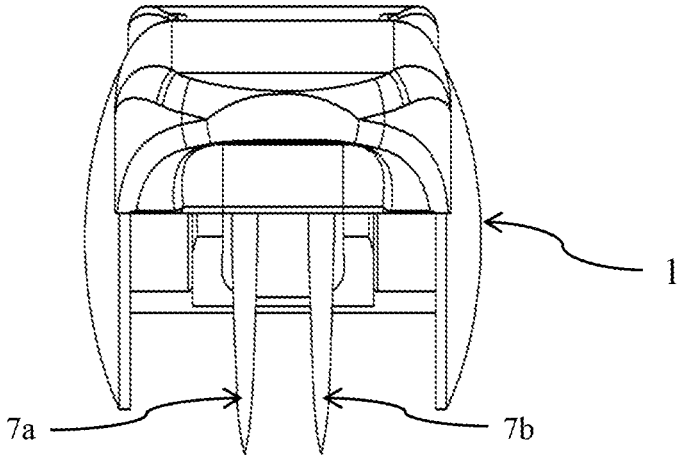
FIG. 22 is a perspective view of the front end of the top pivot shaft section.

FIG. 22 is a perspective view of the front end of the top pivot shaft section 1 illustrating the positioning of the metal conductor pins 7*a* and 7*b*.

Figure 23:
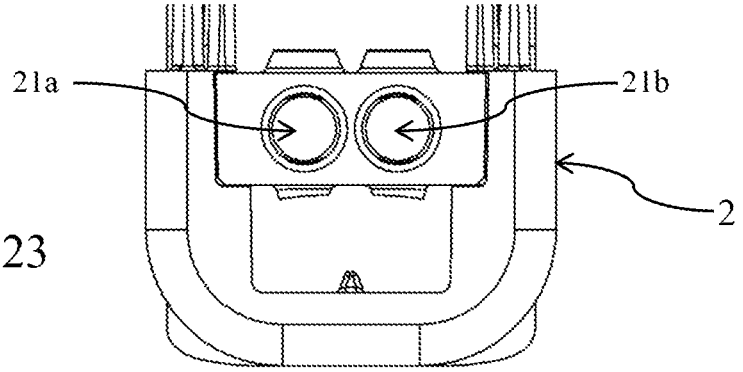
FIG. 23 is a perspective view of the front end of the base pivot hub section and the front end of the insert device after it is locked into the base pivot hub section.

FIG. 23 is a perspective view of the front end of the base pivot hub section 2 and the front end of the insert device 20 as it is locked into the base pivot hub section with the front end of the fixture conductor wire channels 21*a* and 21*b*.

Figure 24:
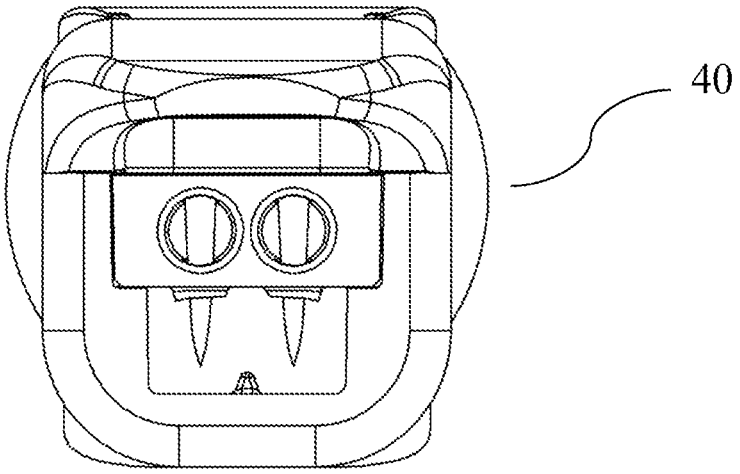
FIG. 24 is a perspective view of the front end of the connector assembly after the top pivot shaft section and the base pivot hub section with the insert device are interlocked.

FIG. 24 is a perspective view of the front end of the cable connector assembly 40 after the top pivot shaft section and the base pivot hub section holding the insert device are interlocked.

Figure 25:
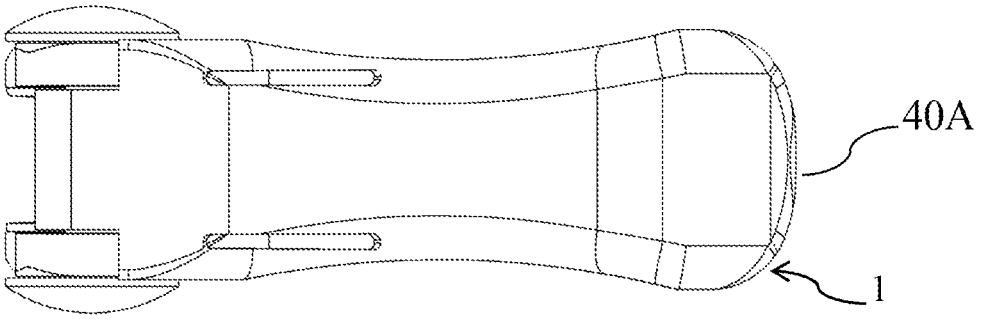
FIG. 25 is a top plan view of the complete connector assembly with the insert device.

FIG. 25 is a top plan view of the complete connector assembly with the insert device.

Figure 26:
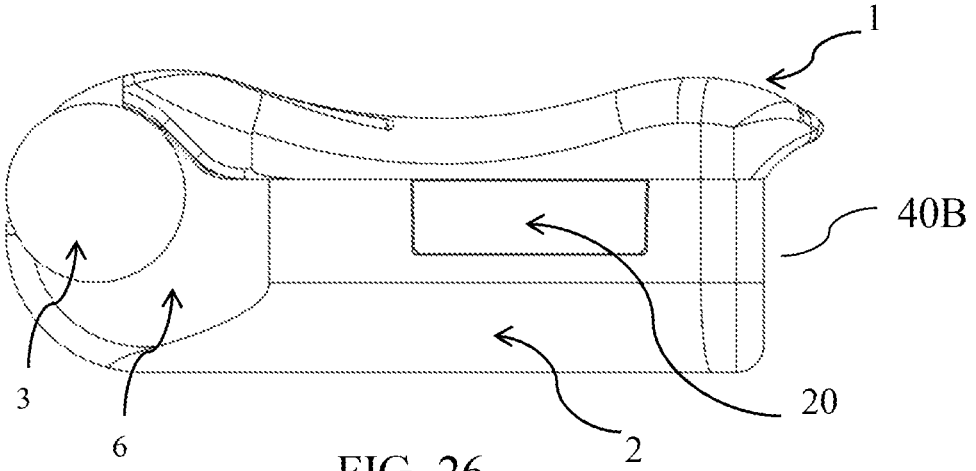
FIG. 26 is a side view of the complete connector assembly with the insert device.

FIG. 26 is a side view of the complete connector assembly with the insert device. This view shows the insert device 20 between the top pivot shaft section 1 and the base pivot hub section 2.

Figure 27:
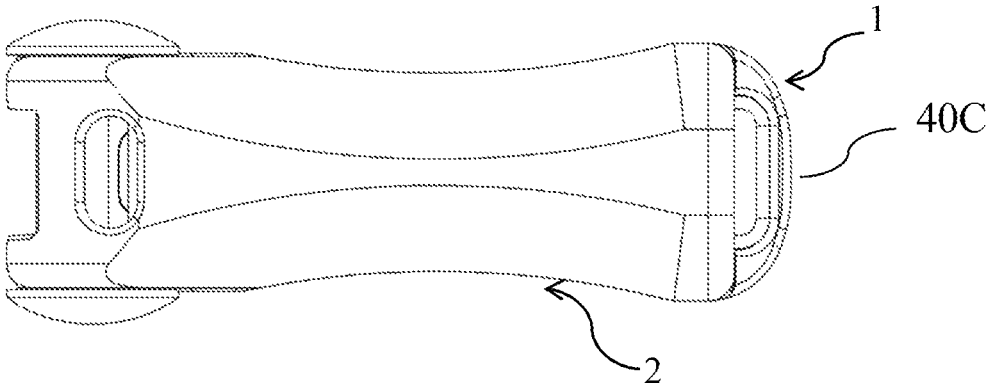
FIG. 27 is a bottom plan view of the complete connector assembly with the insert device.

FIG. 27 is a bottom plan view of the complete connector assembly with the insert device.

The foregoing description of the invention through its figures and preferred embodiments should not be construed to limit the scope of the invention. It is to be understood that the embodiments of the present invention as described herein do not limit any application or scope of the invention and that the invention can be carried out and practiced in various ways and implemented in embodiments other than the ones outlined in the description above. It is to be further understood that the phraseology and terminology used to describe the invention are for descriptive purposes only. It should be understood and obvious to one skilled in the art that alternatives, modifications, and variations of the embodiments of the present invention may be construed as being within the spirit and scope of the appended claims.

What is claimed is:

1. A cable connector assembly comprising:

a top part containing a pivot shaft structure member having interlocking guide slots;

a base part containing a pivot hub structure member having interlocking guide posts to mate with said interlocking guide slots on the said pivot shaft structure member;

said base part containing the said pivot hub structure member having specially shaped pivot hub sockets at a top end of said pivot hub structure member;

said top part containing the said pivot shaft structure member having specially shaped pivot shafts at a bottom end of said pivot shaft structure member;

said specially shaped pivot shafts of said top pivot shaft structure member constructed to slide into the said specially shaped pivot hub sockets of said pivot hub structure member to hold the said top part containing the pivot shaft structure member hingedly up at ninety degrees at one end over the said base part containing said pivot hub structure member;

said top part containing the pivot shaft structure member and said base part containing the pivot hub structure member interlocking to complete closure when said top part containing the pivot shaft structure member is rotated at ninety degrees to said base part containing the pivot hub structure member;

an insert structure member fitted in the said base part containing said pivot hub structure member;

said insert structure member having a set of fixture conductor wire channels to hold a set of fixture conductor wires that insert into a front end of said insert structure member;

a source conductor channel at the base of said base pivot hub structure member to hold a source conductor wire that insert into a back end of said insert structure member;

said source conductor wire held below said fixture conductor wires that are held in said fixture conductor channels in said insert structure member;

a set of metal conductor pins having sharp pointed ends molded to a top inside surface of said top part containing the pivot shaft structure member;

said metal conductor pins having a straight shape and aligned to penetrate precisely and completely through said set of fixture conductor wires and said source conductor wire with minimal displacement of the cable insulation of said fixture conductor wires and the source conductor wire; and a unique design of said top part containing the pivot shaft structure member and the base part containing said pivot hub structure member that allows for a smallest diameter of circumference at a mid-section of said cable connector assembly for the use of a closure device if needed to secure the cable connector in place permanently.

2. The cable connector assembly of claim 1 wherein the pivot shaft structure member and the pivot hub structure member are modified to accommodate the insert structure member.

3. The cable connector assembly of claim 1 wherein the straight metal conductor pins on the pivot shaft structure member penetrate the fixture conductor wires held in the fixture conductor wire channels in the insert structure member completely first before penetrating the source conductor wire held in the source conductor wire channel at the base of the base pivot hub structure member.

4. The cable connector assembly of claim 1 wherein specially designed ridges around molds holding the metal conductor pins on the top part containing the pivot shaft structure member and another set of specially designed ridges on the top and bottom of the insert structure member along with a set of specially designed ridges on the pivot hub structure member create a water tight seal when the connector assembly is fully closed.

5. The cable connector assembly of claim 1 wherein the fixture conductor channels in the insert structure member allow for the insertion of a water proofing agent such as silicone grease to augment the water tight seal achieved by the ridges on the top part containing the pivot shaft structure member and the ridges on the base part containing the pivot hub structure member.

* * * * *